United States Patent [19]

McLean

[11] 4,317,697

[45] Mar. 2, 1982

[54] SEALING MECHANISM

[75] Inventor: John R. McLean, Richmond, Va.

[73] Assignee: Reynolds Metals Company, Richmond, Va.

[21] Appl. No.: 191,828

[22] Filed: Sep. 29, 1980

[51] Int. Cl.[3] ..... B30B 15/04; B30B 15/34

[52] U.S. Cl. ..... 156/583.1; 100/93 P; 100/257; 100/264; 156/515; 493/203; 493/209

[58] Field of Search ..... 156/583.1, 583.6, 580, 156/515; 100/93 P, 257, 264, 270; 38/25, 26; 493/203, 209

[56] References Cited

U.S. PATENT DOCUMENTS

| | | | |
|---|---|---|---|
| 2,555,139 | 5/1951 | Knowles | 493/209 |
| 3,454,741 | 7/1969 | Stewart | 100/93 P |
| 3,574,039 | 4/1971 | Fehr et al. | 156/515 |
| 3,640,187 | 2/1972 | Mundus | 493/203 |
| 4,040,237 | 8/1977 | O'Brien | 100/264 |
| 4,133,260 | 1/1979 | Gundal | 100/257 |

OTHER PUBLICATIONS

Reynolds Metals Company Blueprint No. E-2249, Jun. 16, 1977.

*Primary Examiner*—Michael G. Wityshyn
*Attorney, Agent, or Firm*—Lyne, Girard & McDonald

[57] ABSTRACT

An adjustable sealing mechanism for heat sealing packages in plastic film is disclosed. The sealing apparatus includes means for vertically adjusting the position of the heat seal to accommodate objects of varying heights while maintaining a vertically controlled heat seal at the ends of the object.

5 Claims, 2 Drawing Figures

SEALING MECHANISM

BACKGROUND OF THE INVENTION

Objects are routinely packaged within tubes of plastic film. In such operations, a tube may be formed of a plastic film, with the tube being closed by means of an electrostatic or other sealing operation along its length and the object being sealed within the plastic film by means of a pair of heat seals at either end of the plastic film tube. Depending upon whether a shrink film is employed, the completed package may or may not then be subjected to a shrink tunnel to firmly wrap the film around the object and complete the packaging operation.

When employing such a packaging operation, it is often desired to vertically position the heat seals at approximately the vertical center of the object. In some cases, however, due to the shape of the object being packaged, it is desired to provide a heat seal at a consistently controlled position, other than at the vertical center. The ultimate goal of this seal placement is to equalize the stresses throughout the film, preventing film breakage and producing a more reliable seal.

A problem in designing heat sealing apparatus is the necessity for providing a sealing mechanism which can be fully vertically adjusted within its predetermined range to accommodate objects of varying heights while maintaining a vertically controlled seal.

SUMMARY OF THE INVENTION

By means of the present invention, a heat sealing apparatus which can be readily adjusted to accommodate objects of varying vertical heights while maintaining vertically controlled heat seals is disclosed. The sealing mechanism includes an upper sealing member, a lower sealing member, and vertically adjustable linkage means for vertically positioning the upper and lower sealing members. This vertically adjustable linkage means permits objects of varying heights to pass between the upper and lower sealing members when the sealing members are in their open position and operates to close the sealing members upon one another to provide a vertically controlled seal.

BRIEF DESCRIPTION OF THE DRAWINGS

The sealing mechanism of the present invention will now be more fully described with reference to the drawings in which.

DETAILED DESCRIPTION OF THE PREFERRED EMBODIMENT

Figure 1:
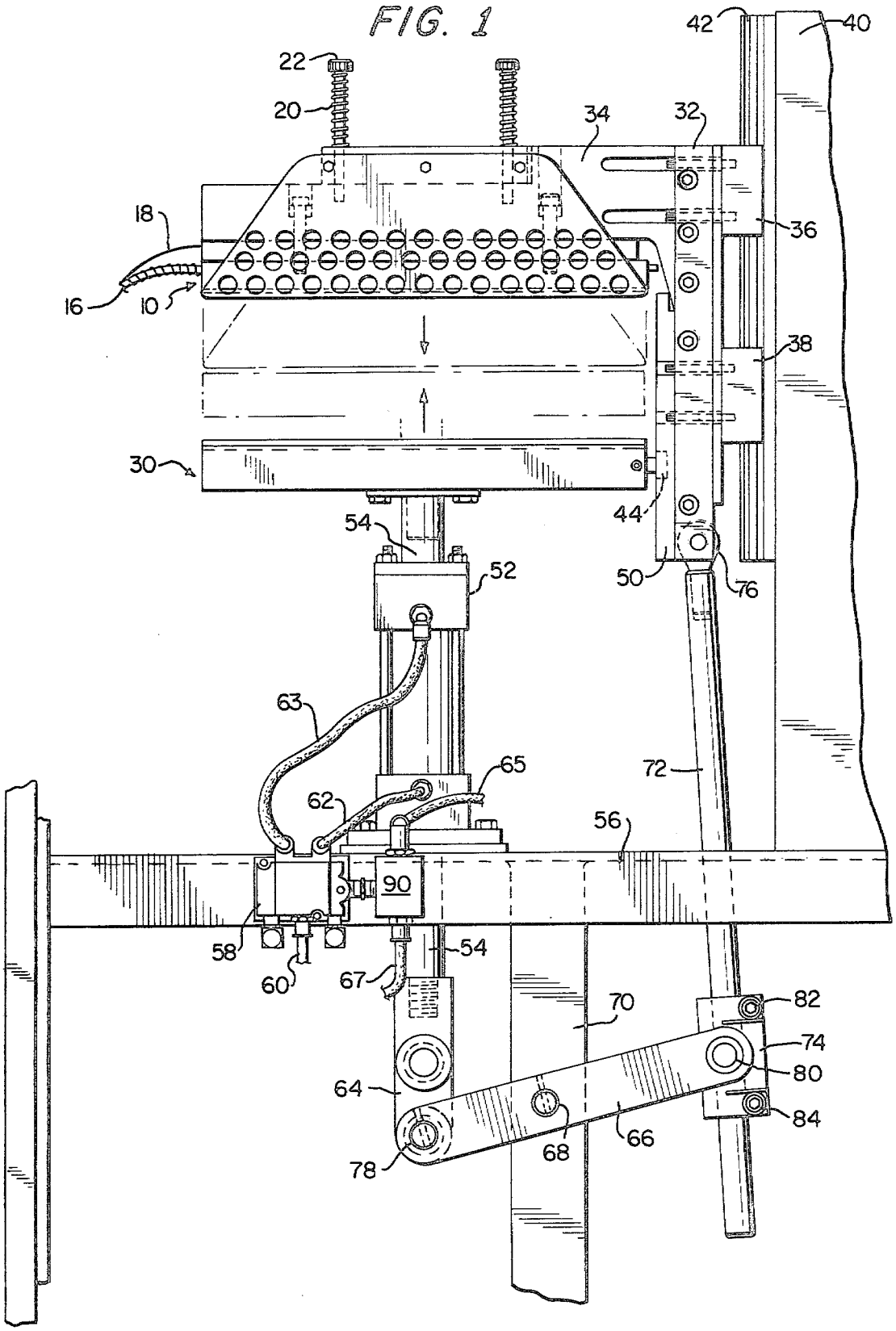
FIG. 1 is a front elevational view illustrating the sealing members and linkage mechanism of the present invention.
Figure 2:
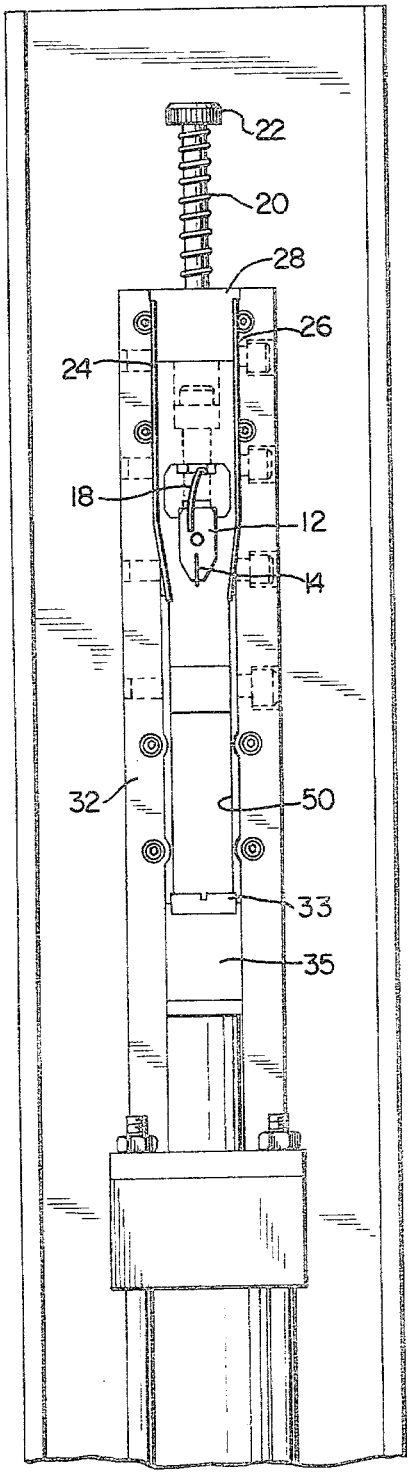
FIG. 2 is a partial left side view illustrating the positioning of the sealing members with respect to one another prior to a sealing operation.

Turning now to the FIGURES, a heat sealing apparatus according to the present invention is illustrated. The apparatus includes an upper sealing mechanism 10 and a lower sealing mechanism 30. The upper sealing mechanism 10 includes a heater bar 12 and a knife member 14. The heater bar 12 is heated electrically from current obtained through line 16, with the temperature of the heater bar 12 being monitored by thermocouples (not shown) connected to line 18. The heater bar 12 is rigidly mounted to support member 34. Film hold-down members 24 and 26 are firmly mounted onto bar 28, and are spring-mounted by means of springs 20 and pins 22 to be compressible with respect to heater bar 12, as the upper sealing mechanism 10 connects lower sealing mechanism 30, to permit blade 14 to extend beyond the edges of the hold-down members 24 and 26, while the hold-down members 24 and 26 firmly hold the plastic film in place against the lower sealing mechanism 30 during the sealing operation.

The lower sealing member 30 comprises a felt or rubber sealing member 33 and a back-up plate 35.

The operation of this combined upper and lower sealing member system is more fully described in copending U.S. application Ser. No. 137,495, filed May 4, 1980, which application is assigned to the assignee of the present application and the disclosure of which is hereby incorporated herein by reference.

Clearly, other sealing mechanisms employing upper and lower sealing elements, such as hot wire sealers, bar sealers and the like could be substituted for the upper sealing member 10 and lower sealing member 30 illustrated.

The upper sealing mechanism 10 is mounted on a vertically reciprocal support member 32 by means of the connecting support bracket 34. The vertically reciprocal supporting member 32 is guided for vertical movement by a pair of follower members 36 and 38. These following members 36 and 38 run vertically along a track 42 connected as a portion of a supporting frame member 40. The lower sealing member 30 is aligned for vertical reciprocation by means of a follower 44 mounted within a track 50 formed as a portion of supporting member 32.

Vertical motion of the upper and lower sealing members 10 and 30 is accomplished by means of a compressed air cylinder 52. This cylinder 52 includes a piston rod 54 which passes through both ends of the cylinder 52. Cylinder 52 is mounted on a frame member 56 and is connected to an air valve 58, which valve 58 is in turn connected to a source of compressed air (not shown) through line 60.

In operation, the sealing apparatus is initially in the fully retracted position shown in FIG. 1. Upon receiving an activation signal through shuttle valve 90, which valve 90 receives its signal from sources not shown through either line 65 or 67, valve 58 permits compressed air to flow from intake line 60 through outlet line 62. This causes piston rod 54 and the lower sealing member 30 attached thereto to move upwardly. Rotation of the lower sealing bar 30 during its upward travel is prevented by means of the follower 44 being held within track 50. As the piston rod 54 moves upwardly, it not only pushes lower sealing member 30 upwardly, but also acts upon a connecting link 64, pulling it upwardly. This connecting link is connected to a pivotable bar member 66, which is pivotably mounted by pin means 68 onto frame member 70 and mounted by pins 78 and 80 onto connecting link 64 and connecting rod 72, respectively. The connection to rod 72 is by means of a slideable, adjustable coupling block 74 coupled to bar 66 by pin 80, whose function will be further described below. Thus, as the piston rod 54 and the connecting link 64 move upwardly, bar 66 rotates about pivot 68, pulling rod 72 downwardly, and, due to the connecting pin 76 connecting rod 72 to slideable bar 32, pulling bar 32 and upper sealing mechanism 10 downwardly along track 42, with track 42 and followers 36 and 38 preventing rotation of upper sealing member 10, until the upward motion of the lower sealing member 30 and the downward motion of the upper sealing member 10 meet at the predetermined sealing position.

The relative amounts of vertical motion for the upper sealing mechanism 10 and the lower sealing member 30 is determined by the connecting bar 66. As previously mentioned, connection bar 66 is pivotably mounted upon pin 68 and is also mounted by means of pins 78 and 80 to connecting link 64 and slideable, adjustable coupling block 74, respectively. The ratio between the distances between pins 78 and 68 and 68 and 80 determine the ratio of motion for the upper sealing member and the lower sealing member. As illustrated, the ratio between pins 80 and 68 and pins 78 and 68 is 60:40. Thus, the upper sealing mechanism 10 will move 60% of the total movement of the two members 10 and 30. Or, for example, the upper sealing mechanism 10 would move three inches (7.62 centimeters) for every two inches (5.08 centimeters) of movement of the lower sealing member 30. This ratio may be altered by a change in the bar member 66 to provide a different ratio between the pins 78, 68 and 80. It has been found that improved results are obtained when the upper sealing member 10 moves vertically downwardly a slightly greater distance than the lower sealing bar mechanism 30 moves upwardly, to provide clearance for loose film, clearance for the object being packaged and the like.

After the sealing has been accomplished, the signal to valve 90 ceases, allowing spring-loaded valve 58 to reverse the air flow, now flowing compressed air through line 63. This acts to move the piston rod 54 downwardly and reverses the corresponding actions previously mentioned.

As previously mentioned, the system is designed for simple adjustments to varying package heights. The slideable, adjustable coupling block 74 is slideably mounted on rod 72. By loosening the mounting bolts 82 and 84, the bar 72 may be moved upwardly or downwardly to change the fully open height of the upper sealing mechanism 10. The positioning of the lower sealing mechanism 30 remains unchanged. Due to the connecting bar 66, the ratio of movement between the upper sealing member 10 and the lower sealing member 30 will remain the same, wherever the upper sealing mechanism 10 is originally located. Thus, consistently vertically controlled seals may be obtained for varying package heights by means of a single adjustment.

From the foregoing, it is clear that the present invention provides a heat sealing mechanism which reliably produces heat seals in a controlled vertical position, while being adjustable to accomplish sealing of packages of varying heights.

While a presently preferred embodiment of the present invention has been illustrated and described, it will be understood that the invention may be otherwise variously embodied and practiced within the scope of the following claims.

I claim:

1. A heat sealing apparatus comprising an upper sealing member, a lower sealing member, an air cylinder for moving said lower sealing member in an upward direction, linkage means connected to said air cylinder for moving said upper sealing member in a downward direction, a pivotable bar for controlling the relative amounts of vertical movements of said upper sealing member and said lower sealing member and means for spacing said upper sealing member from said lower sealing member prior to movements thereof, said means for spacing comprising a mounting bracket connected to said upper sealing member, an adjustable collar connected to said pivotable bar and a connecting rod mounted between said mounting bracket and said adjustable collar.

2. The apparatus of claim 1 wherein said pivotable bar is pin mounted to said air cylinder, said collar and to a frame upon which said apparatus is mounted.

3. The apparatus of claim 2 wherein said frame includes a track member and said mounting bracket includes a follower to prevent rotation of said upper sealing member during movement thereof.

4. The apparatus of claim 3 wherein said mounting bracket includes a track member and said lower sealing member includes a follower to prevent rotation of said lower sealing member during movement thereof.

5. The apparatus of claim 1 wherein said air cylinder is controlled by a spring-loaded shuttle valve.

* * * * *